US005723039A

United States Patent [19]

Zosimov et al.

[11] Patent Number: 5,723,039

[45] Date of Patent: Mar. 3, 1998

[54] PROCESS FOR REMOVAL OF ORGANO-SULFUR COMPOUNDS FROM LIQUID HYDROCARBONS

[75] Inventors: Alexandr Vasilievich Zosimov; Valeriy Vasilievich Lunin; Yuriy Mikhailovich Maksimov, all of Moscow, U.S.S.R.

[73] Assignee: Catalytic Sciences, Ltd., Nassau, Bahamas

[21] Appl. No.: 630,758

[22] Filed: Apr. 11, 1996

[51] Int. Cl.[6] ..... C01G 17/00

[52] U.S. Cl. ..... 205/696; 205/704; 208/224; 208/244; 208/249; 208/266; 208/271; 208/273; 208/274; 208/275

[58] Field of Search ..... 205/696, 704; 208/224, 244, 249, 266, 271, 273, 274, 275

[56] References Cited

U.S. PATENT DOCUMENTS

| | | | |
|---|---|---|---|
| 604,515 | 5/1898 | Bragg . | |
| 2,521,147 | 9/1950 | Brown | 204/79 |
| 3,193,434 | 7/1965 | Weiss | 161/6 |
| 3,193,484 | 7/1965 | Gleim et al. | 204/79 |
| 3,200,054 | 8/1965 | Pursley | 204/79 |
| 3,409,520 | 11/1968 | Bolmer | 204/101 |
| 3,793,171 | 2/1974 | Zabolotny et al. | 204/130 |
| 3,915,819 | 10/1975 | Bell et al. | 204/136 |
| 4,101,635 | 7/1978 | Nambu et al. | 423/242 |
| 4,634,515 | 1/1987 | Bailey et al. | 208/91 |
| 4,695,366 | 9/1987 | Miller et al. | 208/91 |
| 4,772,366 | 9/1988 | Winnick | 204/128 |
| 4,824,818 | 4/1989 | Bricker | 502/163 |
| 5,110,443 | 5/1992 | Gregoli et al. | 208/46 |
| 5,266,173 | 11/1993 | Bandlish et al. | 204/72 |
| 5,414,199 | 5/1995 | Fleischman | 205/770 |

*Primary Examiner*—Arun S. Phasge

*Attorney, Agent, or Firm*—Finnegan, Henderson, Farabow, Garrett & Dunner, L.L.P.

[57] ABSTRACT

A process for purifying a liquid hydrocarbon feedstock containing organo-sulfur compounds wherein an aqueous sulfuric acid solution containing ions of a transition metal, such as vanadium, chromium, manganese, cobalt, cerium or mixtures thereof, is subject to electrolysis to oxidize the metal ions to a higher oxidation state, the electrolyzed solution is emulsified with the feedstock to achieve oxidation of the organo-sulfur compounds to form water soluble sulfur compounds, gaseous products, resinous products; the spent aqueous acidic solution and the purified hydrocarbon product are separated and the spent aqueous solution is recycled via electrolysis.

21 Claims, 2 Drawing Sheets

PROCESS FOR REMOVAL OF ORGANO-SULFUR COMPOUNDS FROM LIQUID HYDROCARBONS

FIELD OF THE INVENTION

This invention relates to the purification of hydrocarbons containing sulfur compounds, and, more particularly, it relates to a process for desulfurizing liquid hydrocarbons containing organo-sulfur compounds by oxidation of the organo-sulfur compounds employing an ion-oxidant which is electrochemically regenerable.

BACKGROUND OF THE INVENTION

For environmental reasons there is an ever-increasing need for liquid hydrocarbon fuels containing very low levels of sulfur, e.g., fuels for motor vehicles having sulfur contents as low as 0.03 wt % (300 ppm) or even down to 0.003 wt % (30 ppm).

Presently, hydrorefining is frequently used for industrial purification of petroleum distillates. Hydrorefining is known to provide nearly complete removal of mercaptans, sulfides and disulfides from liquid hydrocarbons. But, the use of hydrorefining for reducing the thiophene content to a level of 30 ppm is limited because of the expense, and so the sulfur content remains rather high, e.g., about 0.1–0.2 wt %.

While it is possible to use a multistage hydrorefining process employing consequent increased hydrogen partial pressure and a precious metal catalyst to remove such difficult to remove sulfur compounds, this is not considered feasible, due to the expense of installing and operating such a process.

An alternative approach is to extract and absorb these latter sulfur compounds using selective solid sorbents. But thiophenes possess a low reactivity and the customary sorbents do not provide the necessary efficiency of purification.

Some analogs are also known for the electrolytic desulfurization of petroleum products. For example, U.S. Pat. No. 3,193,484 discloses a process for the electrolytic oxidation of mercaptans, which is based on the removal of mercaptans from petroleum fractions via oxidation of mercaptides into disulfides which remain in the electrolyzer. This patent also reviews the prior art as covered in U.S. Pat. Nos. 2,140,194; 2,654,706; and 2,856,353. In this process a stream of fuel is mixed with an electrolyte and the mixture flows through an anodic cell where the mercaptides are converted into disulfides and oxygen is released. More specifically, a feedstock containing acidic impurities (e.g., mercaptans) is subjected to treatment with an alkaline reagent. The preferred reagent is an aqueous solution of an alkali metal hydroxide such as sodium hydroxide. That alkali metal hydroxide chemically interacts with the mercaptans forming e.g. sodium mercaptide, which is then converted into a disulfide, according to the following reaction:

$$2NaSR+O \rightarrow R_2S_2+Na_2O$$

where the required oxygen atoms are produced by the electrolytic decomposition of water. Concurrently, the disulfides are formed via the oxidation of mercaptans on the anode of an electrolytic cell:

$$2RS \rightarrow RSSR+2 \text{ electrons}$$

This process runs only at the electrode surface in a two phase system. The working solution from the anodic cell then flows into a settling tank where the disulfides and oxygen are removed from the solution, after which the solution is washed by ligroin in a scrubber and returned to an extraction column. Because this process runs only at the electrode surface in a two phase system, the purification is not very effective. Also, the method is not appropriate for removing thiophene derivatives.

An electrochemical method of purifying petroleum products is described in U.S. Pat. No. 3,915,819. According to this method, the oil or petroleum products are mixed with an ionizing organic solvent (e.g. methanol, toluene, etc.) and the mixture is exposed to the action of a DC current having a current density of not less than 0.0001 A/cm$^2$ and a voltage of between 2–120V. To speed up the process an aqueous salt solution or solution of bases of alkaline or alkaline-earth metals is introduced into the stock to ensure a pH value of 8–12. The process is conducted for not less than 4 hours in an electrolyzer containing two platinum cylindrical electrodes having a definite ratio of anode/cathode areas. The effectiveness of the desulfurization can be as high as 90%. The shortcomings of the method include: (1) constant control over the process parameters must be provided since the magnitude of current density, voltage and pH change during the process; (2) high power consumption (because of the high resistivity of the electrolyte, most of the consumed electric power is wasted on heating the electrolyte); and (3) the process requires not less than 4 hours because the poor conductivity of the electrolyte does not permit the use of high current densities.

U.S. Pat. No. 4,101,635 discloses a method for oxidizing sulfur dioxide by contacting a sulfur dioxide-containing gas and an oxygen-containing gas with an aqueous solution containing pentavalent vanadium and divalent manganese as an oxidation catalyst, wherein a calcium compound and an oxygen-containing gas are added to the aqueous solution, the resulting gypsum is separated, and the recovered aqueous catalyst solution is recycled for use as the oxidation catalyst.

U.S. Pat. No. 3,793,171 discloses a process for the destruction of oxidizable impurities carried in a gas stream by contacting the gas stream with an aqueous acid stream containing an electrolytically regenerable oxidizing agent, and electrolytically regenerating the oxidizing agent for further treatment of additional amounts of the gas stream. Cobalt in the +3 valence state (Co III) is said to be the most preferred oxidizing agent, and other suitable metals exhibiting at least two different ionic valence states are stated to be chromium (Cr VI/III), manganese (Mn III/II), silver (Ag II/I) and cerium (Ce IV/III). The process disclosed in U.S. Pat. No. 3,793,172 differs from the present invention in that it is not specifically intended for the selective removal of admixtures of heteroatomic compounds from hydrocarbons. Instead, it discloses a process designed to remove oxidizable gases from a gas stream.

At the present time, however, a practical, low-cost and efficient process has not been developed for purifying liquid hydrocarbons, such as petroleum distillates used for fuels, of difficult to remove organo-sulfur compounds.

SUMMARY OF THE INVENTION

A primary object of the present invention is a process for removing organo-sulfur compounds from liquid hydrocarbons. A further object is a process for efficiently and economically purifying liquid hydrocarbons used for fuels and chemical feedstocks of residual, difficult to remove organo-sulfur compounds such as thiophene. Other objects of the invention will become apparent from the following description of the invention and the practice thereof.

In order to achieve the objects of the present invention there is provided a process for purifying a liquid hydrocarbon feedstock containing organo-sulfur compounds, which process comprises: (a) forming an aqueous sulfuric acid solution containing an ion-oxidant with a concentration of transition metal ions in a first, lower oxidation state; (b) passing an electric current through the aqueous solution between an anode and a cathode in an electrolytic cell to oxidize said ions of said ion- oxidant to a second, oxidation state higher than said first oxidation state so as to form a fresh working solution containing the resulting oxidized ions; (c) introducing said feedstock and said working solution into a contacting zone and intimately contacting said feedstock and said working solution therein under conditions effective to oxidize organo-sulfur compounds in said feedstock and form watersoluble, or gaseous sulfur-containing compounds and to reduce said oxidized ions, so as to form a mixture of (i) a spent working solution containing the resulting reduced ions and having said water-soluble compounds dissolved therein and (ii) a purified hydrocarbon product containing a reduced level of said organo-sulfur compounds relative to the level thereof in said feedstock; (d) separating said purified hydrocarbon product and said spent working solution; (e) recovering the separated purified hydrocarbon product; and (f) returning the separated working solution to step (b) above wherein said reduced ions are oxidized to a higher oxidation state. Preferably, the ion-oxidant contains ions of vanadium, chromium, manganese, cobalt or cerium. The sulfuric acid solution preferably contains from about 4 to about 15 moles of sulfuric acid per liter.

As used herein, "ion-oxidant" refers to an active particle in an electrolyte or in a chemical reagent whose composition contains one or more types of such active particles. The ion-oxidant contains one or more metal ions of varying valence (e.g., V, Cr, Mn, Ce, Co) surrounded in the electrolyte with a shell of water molecules, oxygen ions, hydroxyl ions and anions of the electrolyte. The ion-oxidant can accept one or more electrons from the compound being oxidized and can transfer water molecules, oxygen ions, hydroxyl ions and anions of the electrolyte from its shell to that compound.

BRIEF DESCRIPTION OF THE DRAWINGS

The present invention is described herein below with reference to the accompanying drawings, wherein.

DESCRIPTION OF PREFERRED EMBODIMENTS

Figure 1:
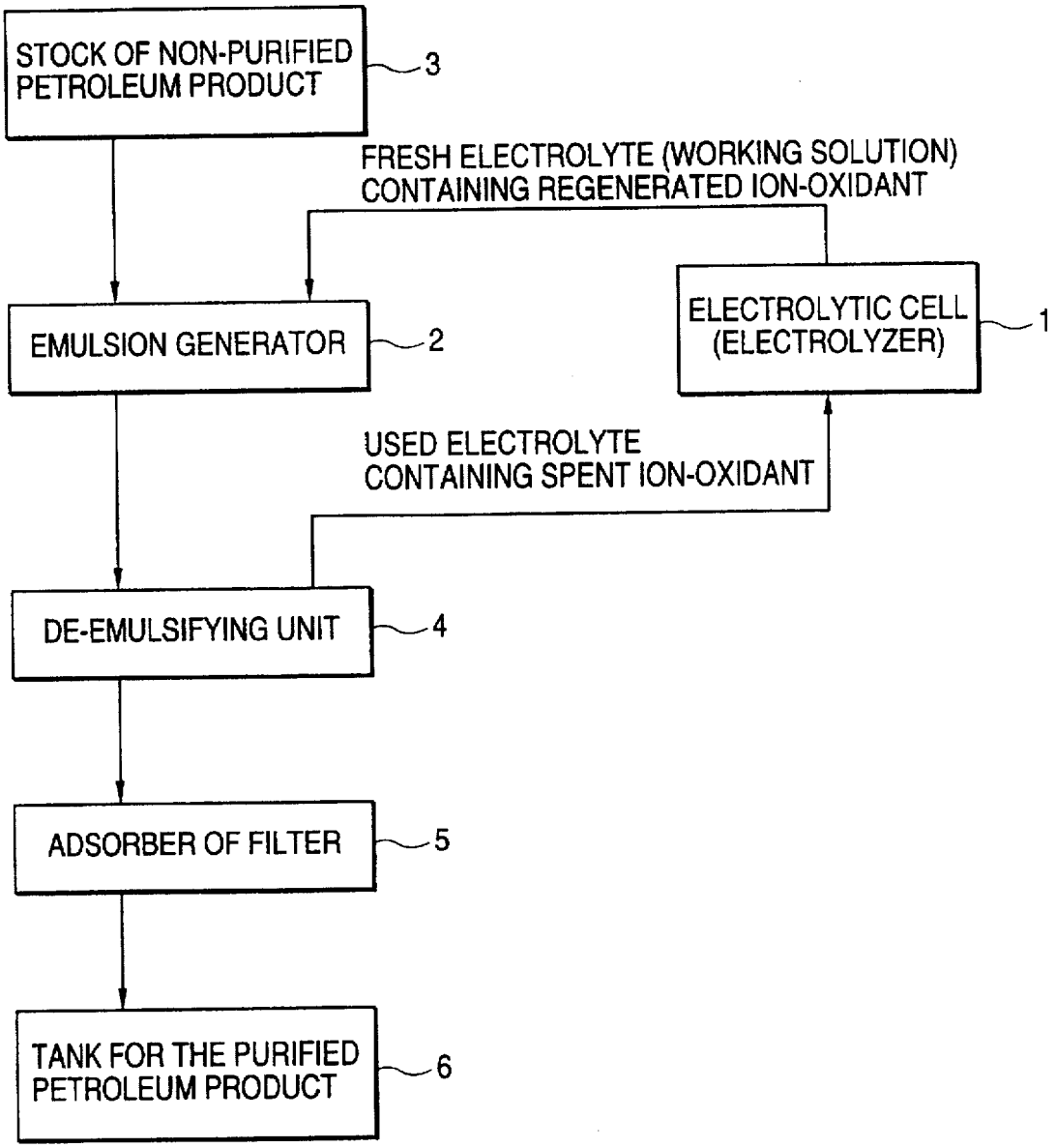
FIG. 1 is a general schematic process flow diagram of a process according to the present invention.

As used herein, "hydrocarbon feedstock" means any fuel oil (e.g. gasoline, diesel fuel, propellant), petrochemical feedstock or the like in the form of a particular oil fraction or particular hydrocarbon. The liquid hydrocarbon feedstocks purified by the present process may be derived from petroleum, coal, oil shale or bituminous sands, etc. and typically are liquid hydrocarbon mixtures containing organo-sulfur compounds.

The preferred feedstocks for the present process have been subjected to a preliminary purification to substantially reduce the content of heteroatomic compounds by hydrorefining, or by other suitable preliminary purification techniques, which also reduce the content of unsaturated or resin-forming compounds. This is so because the present process works to oxidize organo-sulfur compounds. Unsaturated or oxygen-containing compounds also may be oxidized to yield various by-products (e.g. resins), thus reducing the selectivity for desulfurization. Thus, it is generally undesirable for fuel oils of complicated composition (e.g., containing ethers or alcohols) to be purified by the technology. The present invention is preferably employed to provide a fine purification of hydrocarbon feedstocks which have been subjected to hydrorefining (e.g., fuel oils satisfying standards presently in force, i.e. sulfur content <1000 ppm or <10,000 ppm) which contain no, or only minor amounts of oxidizable compounds. In such cases, the present process provides a selective removal of residual sulfur-containing, oxygen-containing, nitrogen-containing compounds and heteroatomic compounds containing heavy metals.

An aqueous sulfuric acid solution is employed in the present process as a carrier for the ion-oxidant and as an electrolyte.

Aqueous solutions of sulfuric acid have been used to remove organo-sulfur compounds from petroleum products by so-called "sulfuric acid purification". In this process an aqueous solution of sulfuric acid at an acid concentration ranging from 2.5 to 18 moles/liter (2.5–18M) (this corresponds to 20–96 wt %) is used to remove various organo-sulfur, unsaturated, or resin-forming compounds. Fuming sulfuric acid with a monohydrate ($SO_3$) concentration of 104.5, or dry sulfuric anhydride ($SO_3$) as a gas can also be used.

Solutions of sulfuric acid with concentrations less than 15M (93 wt %) are used only for removing non-saturated or oxygen-containing compounds from petroleum products. At these concentrations, the main mechanisms involved in the process are polymerization and sulfurization.

In order to remove organo-sulfur compounds from petroleum products via oxidation using the sulfuric acid purification technique, the concentration of sulfuric acid must be greater than 15M (93 wt %). In this case, the sulfuric acid is a spent reagent—its consumption rate exceeds 10 kg per 1 kg of sulfur removed. Moreover, resin-like products (so-called "acidic tar") are formed which are not soluble in the petroleum product and so must be removed via settling, filtration, or centrifuging. The efficiency of the sulfuric acid purification technique with respect to thiophenes is less than 40–50%.

The present method of oxidizing organo-sulfur compounds by means of ion-oxidants preferably uses a sulfuric acid concentration range of 4–15M, i.e. in those concentrations of sulfuric acid (viz., <15M) where sulfuric acid alone (without the presence of any ion-oxidants) does not remove organo-sulfuric compounds from petroleum products.

Also the present method does not use sulfuric acid as a spent reagent which is consumed to oxidize the organo-sulfur compounds. During the oxidation of a molecule of an organo-sulfur compound, the following substances take part: ion-oxidants, hydrogen ions, and water molecules. The products of the incomplete dissociation of sulfuric acid (i.e. $HSO_4$[−] ions) can participate during the early stages of the oxidation process (immediately after the organo-sulfur molecule has been attacked by an ion-oxidant) as a catalyst of the water molecule addition to the partly oxidized organo-sulfur molecule. Like any other catalytic process, the $HSO_4$[−] ions are not consumed.

The spent reagents in the present method of oxidizing organo-sulfur compounds are ion-oxidants (i.e. the ion-oxidants transfer into to a lower oxidation state) and water. In the case of complete oxidation, sulfur is oxidized to form sulfuric acid. Thus, sulfuric acid is a product of the present process, which is formed concurrently with the fuel purification. Some minor consumption of the sulfuric acid may occur because of possible side-reactions involving non-saturated compounds, e.g., polymerization of the non-saturated compounds.

Thus, the results of comparative testing of the present process and the sulfuric acid purification technique are as follows:

a) Regime of concentrated sulfuric acid (i.e. 15–18M). Such concentrated sulfuric acid removes about 40–50% of the organo-sulfur compounds, and the addition into the solution of ion-oxidants does not improve the purification effectiveness.

b) Regime of dilute sulfuric acid (i.e. 4–15M). The standard sulfuric acid purification technique is not effective with respect to thiophenes at such concentrations of sulfuric acid. But the addition of ion-oxidants into the solution provides almost complete removal of all organo-sulfur compounds. The best results are obtained for a sulfuric acid concentration range of 6–12M, and maximum effectiveness is observed within the range of 7–10M, with the concentration of 9M being most effective for the feedstock employed.

c) Regime of low sulfuric acid concentration (i.e. <4M). Thiophenes are not removed if such low concentrations of sulfuric acid are used, although oxygen-sulfur-organic compounds are removed.

Thus, the preferred range of sulfuric acid concentration in the solution is 4–15M, with the range of 6–12M being preferable, and the range of 7–10M providing the maximum effectiveness.

In the present process the ion-oxidants are in the aqueous electrolyte, or sulfuric acid solution, and the organo-sulfur compounds are in the liquid hydrocarbon feedstock. The electrolyte and the feedstock are, for practical purposes, mutually insoluble and form a heterophase system when mixed. Thus, a liquid interface is present to enable the oxidation of the organo-sulfur compounds by the ion-oxidant and subsequent reactions of the organo-sulfur compounds with water or sulfuric acid. The purification rate and purification effectiveness are influenced by the interface area and time the two are in contact. Consequently, it is desirable to mix the feedstock and the electrolyte, e.g., by forming an emulsion, so that they are in intimate contact.

Any known method of providing the interface can be employed to realize the present process of desulfurization. Thus, the heterophase system involving the hydrocarbon feedstock and the working solution may be obtained in the following ways:

1) An emulsion may be formed by mechanical or acoustical mixing and may contain the hydrocarbon feedstock as either a disperse or a continuous phase;

2) Concurrent co-directed flows of the hydrocarbon feedstock and the electrolyte through a porous media, the solid phase of which exhibits similar wetting properties with respect to the hydrocarbon and the working solution (electrolyte);

3) Concurrent co-directed flows of the hydrocarbon feedstock and the electrolyte through a porous media, the solid phase of which exhibits dissimilar wetting properties with respect to the hydrocarbon and the working solution (electrolyte);

4) Concurrent counterflow of the hydrocarbon feedstock and the electrolyte by gravitational or centrifugal forces;

5) Concurrent counterflow of the hydrocarbon feedstock and the electrolyte along solid surfaces (e.g., plates, fibers, etc.) with respect to which the hydrocarbon and the working solution exhibit similar or dissimilar wetting properties.

Any known method may be used to separate the purified petroleum product and the electrolyte. The choice of extractor type is defined mainly by economics.

The ion-oxidants used in the present process contain ions which work as carriers of electrons from the organo-sulfur compounds in the feedstock to an anode of the electrolytic cell. The ions change their charge during such interaction, thus requiring electrolytic regeneration.

Such ions are produced by the following method. The electrolyte is prepared first and consists of, e.g., a 9M aqueous solution of sulfuric acid and the dissolved salt of a transition metal such as V, Cr, Mn, Co, or Ce in which the metal is in either the lowest or intermediate (but not in the highest) oxidation state. The metal salt can be of any type which dissolves in the solution, e.g., chlorides. Since the main electrolyte is sulfuric acid, it is preferable to use sulfates of such metals. In such cases no new ions appear in addition to the ones participating in the chemical process of purification of the hydrocarbon and additional side-reactions are avoided.

Thus, $VOSO_4$, $Cr_2(SO_4)_3$, $MnSO_4$, $Ce_2(SO_4)_3$, or $CoSO_4$ are dissolved in the electrolyte to create the required concentration of one of the ions: $V^{4+}$, $Cr^{3+}$, $Mn^{2+}$, $Ce^{3+}$, $Co^{2+}$ or a mixture of these ions.

Another important aspect is that although standard ion designations are used, such as $V^{4+}$, $Cr^{3+}$, $Mn^{2+}$ or $Co^{2+}$, the ions do not exist in the aqueous solution in exactly these forms. The ions are bonded to water molecules, hydroxide (OH—) or oxygen, or form complexes of two or more ions. Because of the nature of the process of liquid hydrocarbon feedstock purification, such hydrate shells around the ions and their bonds to oxygen are very important factors in the process. It is impossible to specify the exact structure or properties of the shells of the ions or their complexes because they are subject to change depending on parameters which are uncontrollable during purification, e.g., the concentration of hydrogen ions (H+) changes during both the oxidation of ions on the anode and the oxidation by the ions of the organo-sulfur compounds. So, the concentration of hydrogen ions and the type and properties of ion-oxidants also change over time in the reaction space.

Thus, the ion-oxidants contain transition metal ions (e.g., V, Cr, Mn, Co) in different oxidation states at different stages of the process. As noted above, the ion-oxidant is not just a metal ion, but a structure containing the metal ion. Also, the oxidation states of the ions change during the process. Thus, manganese can exist in several oxidation states: $Mn^{2+}$, $Mn^{3+}$, $Mn^{4+}$, $Mn^{6+}$, $Mn^{7+}$. It is preferable to use ions $Mn^{2+}$ or $Mn^{3+}$ in the purification technology. But, it cannot be guaranteed that, e.g., only ions $Mn^{3+}$ are produced because of the possibility of the spontaneous transition of $Mn^{3+}$ ions into other oxidation states.

The electrolyte solution containing the metal ions in the lowest or intermediate oxidation state are subjected to electrolysis by passing a DC current through the electrolyte in an electrolytic cell. The metal ions are oxidized on an anode therein and transferred into a higher oxidation state.

Oxidation of ions on an anode can be provided either in a regime of constant current density or constant voltage (potential) applied between an anode and a cathode. The properties of the generated ions (i.e. metal oxidation state) are defined by the anode potential. A constant potential (as opposed to a constant current) was used during laboratory experiments to produce ions having the desired oxidation state. However, this approach to ion-oxidant generation may not be desirable for use in industrial plants. A simpler approach is to conduct the ion-oxidant generation in a regime of constant anode current density. This latter approach is based on a relation between the anode current density and the electrochemical reaction potential of the ions. This relation, however, is not a single valued function because the anode current density depends on many factors, e.g., the nature of the anode material, the anode surface contamination (e.g. by organic impurities adsorption), the ion concentration in the electrolyte, the electrolytic cell design, the hydrodynamic regime and the presence of other ions in the electrolyte which can also be oxidized (i.e. side-reactions). The design and operation of the electrolytic cell are not critical and many variations thereof may be used, provided that the cell allows the production of metal ions in the second higher oxidation state at a rate sufficient for oxidizing the organo-sulfur compounds in the hydrocarbon feedstock and provides the desired level of purification of the feedstock.

The ion-oxidants are generated by an electrochemical reaction on the anode of the electrolytic cell, which reaction changes the metal ions in the ion-oxidant to a higher oxidation state, i.e., to an oxidation state higher than the initial one. Such processes and apparatus for the oxidation of metal ions are well known and need not be described herein in detail. See, for example U.S. Pat. No. 3,793,171, which is incorporated herein by reference.

The present process of desulfurization is not truly a catalytic one, since the ion-oxidants are a chemical reagent which is consumed during the time when the electrolyte and liquid hydrocarbon feedstock are in contact in the heterophase mixture. The term "consumed" means that this reagent is transformed during oxidation of the organo-sulfur compounds into another form (i.e. to ions of a lower oxidation state). While such ion-oxidants are present in the electrolyte and in contact with the organo-sulfur containing feedstock, the oxidation of organo-sulfur compounds proceeds. So, the lower limit of the ion concentration in the electrolyte can be considered as slightly greater than zero (operability of the present process was demonstrated at a concentration of ion-oxidant as low as 0.002 moles per liter of electrolyte).

The rate at which the ion-oxidant is consumed will define the purification rate. For example, if the feedstock contains 3000 ppm of sulfur (i.e. about 0.1 mole of sulfur per liter of the feedstock) and this sulfur is present in the form of thiophene derivatives, then 2 moles of electrons (i.e. 20 electrons per atom of sulfur) should be accepted by the ion-oxidant from the organo-sulfur compounds. If the ion-oxidant includes chromium ions of the oxidation state 6+ (i.e. $Cr^{6+}$), then about 0.6 mole of ion-oxidant is required to purify one liter of the feedstock (since 3 electrons are accepted during $Cr^{6+} \rightarrow Cr^{3+}$ transition). It does not matter what the particular concentration of the ion-oxidant is, e.g., if the concentration of the ions is 0.1 mole per liter of electrolyte, then 6 liters of the electrolyte are required to purify 1 liter of the feedstock product from sulfur. And if this concentration is less by a factor of 10 or 100 then proportionally more electrolyte is needed.

However, the above ratio also provides only an estimate of the specific ion consumption, because in a commercial hydrocarbon feedstock sulfur can exist in the form of other organo-sulfur compounds, or there may be incomplete removal of sulfur. Uncontrollable side-reactions are also possible, affecting the specific ion-oxidant consumption. So the range of 10–40 is a reasonable rough estimate of the preferred range of electrons accepted from the organo-sulfur compound per one atom of sulfur removed.

According to the above and to the fact that the concentration of ion-oxidant in the sulfuric acid solution is a difficult parameter to control, the concentration of the parent metal ions in the electrolyte may range from slightly greater than zero up to a concentration corresponding to the saturation point of the metal salt used in the solution. In order to generate ion-oxidants most effectively, a saturated solution of the parent metal ions (i.e., V, Cr, Co, Mn, Ce), or their mixtures, in the electrolyte is preferable. The saturated solution can be prepared by dissolving the metal oxides, or their salts, in the electrolyte consisting of the selected sulfuric acid concentration (e.g., 9M) until a nonsoluble salt residue is observed. The produced solution can then be dissolved with pure electrolyte of the same or a different sulfuric acid concentration to provide a lower concentration of the metal ions (e.g., down to 1% of the metal ion concentration in the saturated solution). This method was tested experimentally for various electrolytic solutions. At least down to 1% of the metal ion concentration in the saturated metal ion solution was tested, but no lower limit of the metal ion concentration was observed.

The sulfuric acid solution containing the metal ions is subjected to electrolysis to generate ion-oxidants containing metal ions in an oxidation state higher than that of the ions before the electrolysis. The optimal hydrocarbon feedstock/electrolyte volumetric ratio is derived from the initial concentration of sulfur in the feedstock and the desired sulfur concentration in the purified product. In practice, an electric current is passed through the electrolytic cell in an amount and at a voltage which is required to accept about 1 to 200 electrons from the organo-sulfur compound per atom of sulfur contained in the feedstock, with the preferred value being 10–40 electrons per atom of sulfur. It is this parameter, viz., the number of electrons accepted from the organo-sulfur compound per atom of sulfur removed, that is important. The particular amount of ion-oxidants in the higher oxidation state compared to the amount of ion-oxidants in the lower oxidation state (see U.S. Pat. No. 3,793,171) is not important. The corresponding value of the amount of electric current passed through the electrolytic cell can be easily calculated from the following relation: the condition of one electron per one atom of sulfur removed corresponds to the amount of electric current passed being equal to Faraday's Constant (i.e., 96520 coulombs per one mole of sulfur). Thus, the claimed value of about 10–40 electrons per atom of sulfur removed corresponds to that amount of electric current passed through the electrolytic cell which is equal to about $(1–4)\times10^6$ coulombs per one mole of sulfur removed.

The present process preferably is conducted at ambient temperature. Although electrolysis may result in some heating of the electrolyte, this generally causes only a minor temperature rise which may be disregarded in most instances.

Higher electrolyte temperatures will result in higher rates of ion oxidation on the anode and faster kinetics in the heterophase reaction at the hydrocarbon/electrolyte interface. Also, higher temperature affects the concentration of saturated metal salt solutions, thus increasing the maximum allowed concentration of parent metal ions in the electrolyte. Because of this and the fact that the oxidation potential of $Co^{3+}$ is 1.5 to 2 times higher than the oxidation potentials of the other ions used in the present invention, $Co^{3+}$ ions are less suitable for the purpose of the present invention than are $V^{5+}$, $Cr^{6+}$, $Mn^{3+}$, or $Ce^{4+}$ ions. (Higher values of the oxidation potential affect the selectivity of the oxidation reactions of heteroatomic compounds.) This is in sharp contrast to the process disclosed in U.S. Pat. No. 3,793,171, in which the $Co^{3+}$ ion is claimed to be the preferred one.

All these effects are positive from the point of view of the rate of the purification process. However, a temperature rise will also increase the rates of side-reactions, thus making the process less selective (e.g. resulting in higher resins yield). In addition, ion-oxidants (e.g. $Co^{3+}$) can decompose molecules of water at elevated temperatures and thus be wasted. Thus lower temperatures, e.g. about 25° C. or lower are generally preferred to improve the process selectivity, and it is preferable to generate the metal ions, e.g., $Co^{3+}$, at an even lower electrolyte temperature, e.g. about 0° C.

In principle, for each type of hydrocarbon feedstock, an optimal process temperature range can be readily determined, depending on the selected criteria of effectiveness (e.g. minimal resins yield or minimal electric power consumption, etc.).

Typically, the present process will be conducted at normal, atmospheric pressure. However, it is well known that pressure can affect the processing. Thus, higher oxygen partial pressure in the anode area may be employed to reduce the rate of oxygen releasing side-reactions, thus increasing the upper limit of the allowed anode current density.

A purpose of the present invention is to increase the effectiveness of hydrocarbon feedstock desulfurization and so increase the productivity of the purification unit. These goals may be achieved by the preferred embodiment of the present invention described hereinbelow.

The ion-oxidant is electrolytically generated in the aqueous sulfuric acid solution as described above. After that, the aqueous solution containing that ion-oxidant is mixed with a liquid hydrocarbon feedstock to produce an emulsion. Desulfurization is provided by the oxidized ions of the ion-oxidant which are reduced during oxidation of the sulfur-containing compounds in the feedstock. The sulfur is removed from the feedstock by forming water-soluble compounds of sulfur which go into the aqueous working solution in the form of ion compounds or gaseous compounds of sulfur (e.g. $SO_2$) which evolve from the solution. After the emulsion decays and the hydrocarbon and aqueous phases are separated, a purified petroleum product and a spent aqueous working solution containing reduced metal ions are formed. The ions in the spent working solution are regenerated via electrolytic oxidation. One or more of the following ions may be used as the ion-oxidant: manganese, vanadium, chromium, cobalt and cerium.

The present process can be realized by the apparatus described with reference to the schematic diagram shown in FIG. 1.

Such apparatus includes an electrolytic cell (1), an emulsion generator (2), a source for supplying liquid hydrocarbon feedstock (3), a de-emulsifying unit (4), an adsorber or filter (5) and a tank for the purified product (6). If desired, a column may be provided for the distillation of the purified hydrocarbon product.

In the process the sulfuric acid solution containing the desired concentration of the transition metal ions in a high oxidation state is fed to the emulsion generator (2) from the electrolytic cell (1). Concurrently, the hydrocarbon feedstock is also fed into the emulsion generator (2) from the feedstock source (3). The feedstock comes into intimate contact with the electrolyte solution to form an emulsion. The contact between the feedstock and the working solution is maintained for a period of time sufficient to permit the ion-oxidant to oxidize the organo-sulfur compounds in the feedstock. The oxidation of sulfur-containing compounds in the feedstock occurs along the liquid-liquid interphase boundaries in the presence of an ion-oxidant, the ions of which are reduced during that reaction, and the produced water-soluble ionic compounds of sulfur go into the aqueous phase.

The reaction mixture then flows into the de-emulsifying unit (4) where the emulsion is broken down. The spent working solution and the purified hydrocarbon product are separated, and the isolated spent working solution then flows into the electrolytic cell (1) to regenerate the ion-oxidant via oxidation of the ions. Purified hydrocarbon products flow through an adsorber or filter (5) (where additional purification may occur) to remove acidic components and/or resinous by-products resulting from the oxidation of the organo-sulfur compounds. The purified hydrocarbon products then flow into the tank (6) for storage.

The recovered purified hydrocarbon product may be passed through a filter (5) comprising an alkaline material which is effective in neutralizing any acidic components and is also effective in removing any resinous products remaining in the purified product. For some applications, such a filter may be made of an inert material, such as silicon oxide or fiberglass.

After being filtered, the purified product may be passed to a distillation column not shown where it is distilled in the presence of an alkaline material, or passed through a particulate adsorbent material (e.g., alumina), to achieve a more complete removal of acids and/or resins. If desired, the adsorbed contaminants may be burned from the adsorbent by contact with an oxygen-containing gas at an elevated temperature.

Alternatively, the separated purified hydrocarbon product may be centrifuged to remove the acidic components and/or resinous by-products.

The following examples demonstrate the effectiveness of the present process for the removal of organo-sulfur compounds from hydrocarbon feedstocks.

EXAMPLE 1

A sample feedstock consisting of decane mixed with +0.1% by volume of thiophene was treated as described below.

An electrolytic cell with a graphite anode of 6 $cm^2$ and a nickel wire cathode of a small area was used to prepare a fresh working solution containing a vanadium ion-oxidant. The process parameters were: current density of 20–30 $mA/cm^2$; the electrolyte was a 0.1M solution of vanadium (III) sulfate in a 5M aqueous solution of sulfuric acid.

Electrolysis was conducted for 1 hour to form a working solution. After that, the feedstock was intimately mixed with the electrolyte solution containing the ion-oxidant for 30 minutes. After separating the phases, a purified petroleum product was obtained (see Table 1).

TABLE 1

| Raw Material (Feed stock) | Sulfur Content of Feedstock (ppm) | Sulfur Content of Purified Product (ppm) | Effectiveness (%) |
|---|---|---|---|
| Decane + Thiophene | 380 | 40 | 89 |

EXAMPLE 2

A diesel fuel containing 0.13% sulfur was treated. An electrolytic cell with a lead anode of 6 $cm^2$ and a nickel wire cathode of a small area was used to prepare a fresh working solution containing a manganese ion-oxidant. The process parameters were: current density of 20–80 mA/cm$^2$; the electrolyte was a 0.1M solution of manganese (II) sulfate in a 15M aqueous solution of sulfuric acid.

Electrolysis was conducted for 1 hour to form a working solution. After that, the diesel fuel was intimately mixed with the working solution containing the manganese ion-oxidant for 30 minutes. After separating the phases, a purified petroleum product was obtained (see Table 2).

TABLE 2

| Raw Material (Feed stock) | Sulfur Content of Feedstock (ppm) | Sulfur Content of Purified Product (ppm) | Effectiveness (%) |
|---|---|---|---|
| Diesel Fuel | 1300 | 340 | 74 |

EXAMPLE 3

A diesel fuel containing 0.13% of sulfur was treated. An electrolytic cell with a lead anode of 6 cm$^2$ and nickel wire cathode of small area was used to prepare a cobalt working solution. Process parameters were: current density of 20–80 mA/cm$^2$; the electrolyte was a 0.1M solution of cobalt (II) sulfate in 9M aqueous solution of sulfuric acid.

Electrolysis was conducted for 1 hour. After that the feedstock was mixed with the solution containing the cobalt ion-oxidant for 30 minutes. After separating the phases a purified petroleum product was obtained (see Table 3).

TABLE 3

| Raw Material (Feed stock) | Sulfur Content of Feedstock (ppm) | Sulfur Content of Purified Product (ppm) | Effectiveness (%) |
|---|---|---|---|
| Diesel Fuel | 1300 | 280 | 78 |

As seen from the above, these experimental data indicate that the present process can be used for the purification of liquid hydrocarbon feedstocks containing organo-sulfur compounds, including thiophenes, even though purification from thiophenes is a most difficult task. The purification effectiveness is high. The efficiency of the operation is also high, and power consumption is low because of:

conductivity of the electrolyte is good, causing no heating;

high yield by the current of the electrode reaction of generating the ion-oxidant;

high effectiveness of ion-oxidant for oxidation of sulfur-containing compounds.

The electrodes of the electrolytic cell need not be made of precious metals, and they can be made of any material which is not readily soluble in the electrolyte (e.g. graphite, titanium, etc.). Since the magnitude of voltage, current density, electrolyte concentration, and electrolyte pH are constant during the electrolysis process, there is no need to control these parameters.

Figure 2:
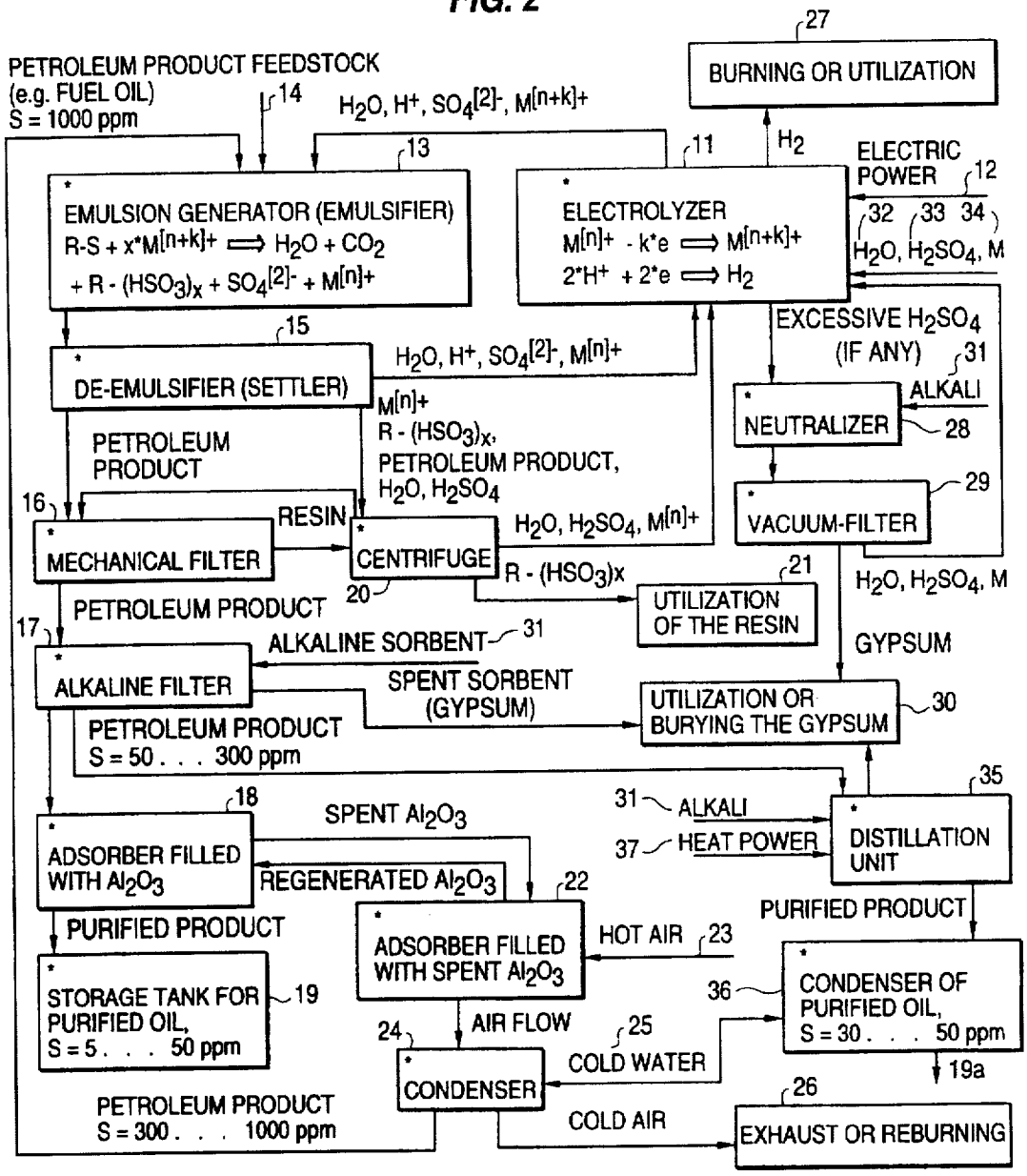
FIG. 2 is a schematic process flow diagram of one preferred process according to the present invention.

Preferred parameters for designing the purification apparatus and process regimes are:

concentration of sulfuric acid in electrolyte: 4 . . . 15M;

electrode materials: anode made from lead covered by oxide; cathode made from nickel;

DC current density at anode: 200 . . . 800 A/m$^2$;

DC current density at cathode: 10000 . . . 20000 A/m$^2$;

total voltage drop across electrolyte including electrodes and porous membrane separating the anode and cathode regions: 1.0 . . . 6 V;

FIG. 2 schematically illustrates apparatus and the process flow of a preferred embodiment of the present invention wherein organo-sulfur compounds and, if desired, other contaminant compounds in hydrocarbon feedstocks can be reduced to varying levels. This preferred embodiment comprises: an electrolyzer (11) which is fed from a DC power supply (12), an emulsifier unit (13) into which an electrolyte is fed from the electrolyzer (11) and petroleum product is fed from a petroleum feedstock source (14), a de-emulsifier unit (15) connected to both the emulsifier unit (i.e. petroleum product/electrolyte emulsion input to de-emulsifier) and the electrolyzer (i.e. spent electrolyte output from de-emulsifier.

The petroleum product outlet from the de-emulsifier unit (15) is equipped with a mechanical filter (16), an alkali filter (17), an adsorber (18) and a storage tank (19) for purified petroleum product. The system also includes a centrifuge (20), connected to a tank (21) for storing the separated resinous products, a sorbent regeneration unit (22) connected to an adsorber (18) a hot air supply (23) and a condenser (24). The condenser is also provided with a cooling water supply (25) and a cold air ventilation unit (26). Petroleum product separated in the condenser is returned and mixed with the petroleum feedstock.

The electrolyzer (11) is also connected to a vessel (27) containing hydrogen gas and to a reactor (28) designed to neutralize the excess electrolyte. This reactor is, in turn, connected to a vacuum filter (29) and to a tank (30) for storing the neutralized electrolyte products (e.g. gypsum). This tank (30) is also connected to an alkaline filter (17) to store the spent alkaline sorbent. The reactor (28) is also connected to an alkaline feed source (31) which also feeds the alkaline filter (17).

The electrolyzer (11) is also provided with supplies of water (32), electrolyte (33) and metal ions (34). The outlets from the de-emulsifier unit (15) and the centrifuge (20) (for removing spent electrolyte) are connected to the electrolyzer (11). The inlet of the centrifuge (20) is connected both to the de-emulsifier unit (15) and the mechanical filter (16). The outlet of the centrifuge is also connected to the mechanical filter (16). The outlet of the alkaline filter (17) can be connected to a distillation unit (still or fractionator) (35) and to a condenser (36). The still (35) is connected to an alkaline supply (31), a heat source (37) and a storage tank for neutralized products (30). The condenser (36) is connected to the cold water supply (25) and the storage tank (19) holding the purified petroleum product.

This system operates as follows:

Oxidation of the metal ions dissolved in the electrolyte (which changes the oxidation state of the ions from the lower or intermediate state to a higher state) occurs on the anode of the electrolyzer (11). Reduction of hydrogen ions and the formation of hydrogen molecules occurs on the cathode of the electrolyzer, and the produced hydrogen is collected in the storage vessel (27). This hydrogen can be used as feedstock for the initial hydro-refining of the petroleum product or saved for other purposes. The oxidation of the metal ions and the reduction of the hydrogen ions proceed via the consumption of DC electric power supplied by unit (12) which is connected to the electrolyzer anode and cathode appropriately. The total voltage drop between the anode and cathode consists of the following components:

Electric potential differences corresponding to the equilibrium oxidation reaction of the metal ions;

Additional potential differences produced during the oxidation of the metal ions due to non-equilibrium reaction conditions (e.g. non-zero anode current density);

Voltage drop generated by passing the electric (ionic) current between the anode and cathode through the electrolyte;

Additional potential differences produced by non-equilibrium reaction conditions during the reduction of hydrogen ions (e.g., non-zero cathode current density)—(Note that the equilibrium potential difference inherent in the reduction of the hydrogen ions is zero).

The equilibrium difference of oxidation potentials of the metal ions is defined by the thermodynamic parameters of the initial and final oxidation products and are as follows:

V[4+]→V[5+]1–1.3 V

Cr[3+]→Cr[6+]1.3 V

Ce[3+]→Ce[4+]1.6 V

Mn[2+]→Mn[3+]1.5 V

Co[2+]→Co[3+]1.8 V

The additional potential difference produced by the oxidation of the electrolytic metal ions is determined mainly by two factors: the anode current density and the ratio of the concentrations of ions in the initial and in the higher oxidation state. Such potential differences, as well as those inherent to the reduction of the hydrogen ions or the voltage drop through the electrolyte, increases electric power consumption required. In addition, these potential differences also increase the rate of side-reactions, e.g. oxygen generation, which reduce the target reaction yield and therefore the efficiency of the process.

Thus, it is important to maintain a relatively low anode current density (e.g. 200–800 A/m$^2$), to use a high concentration of metal ions in the lower oxidation state (e.g. approximately equal to the concentration in a saturated solution), and to have a low concentration of metal ions in the higher oxidation state (e.g. 10–100 times lower than the metal ion concentration occurring in a saturated solution).

The anode current density should be controlled via the appropriate variation of the output parameters of the DC current supply (12). The required concentrations of ions is controlled via controlling the electrolyte flow rate (and, therefore, the residence time) through the electrolyzer (11), regulating the reagents fed into the electrolyzer from the various sources, viz., water (32), sulfuric acid (33), and metal ions (34), and the withdrawal rate of the excess electrolyte into the neutralizer (28).

In order to reduce the voltage drop across the electrolyte, the gap between the anode and cathode in the electrolyzer (11) should be small. Although the use of semipermeable membranes separating the anode and cathode is also possible, it is generally not practical. In order to suppress the possible reduction of the oxidized metal ions on the cathode, the cathode surface area should be much less than the surface area of the anode. Consequently, the cathode current density will be high, e.g. 10,000–20,000 A/m$^2$. Under these conditions mainly hydrogen ions are discharged, since their mobility in the electrolyte is much higher than that of the metal ions.

The working electrolyte solution is fed from electrolyzer (11) into the emulsifier unit (13) along with the petroleum feedstock introduced through line (14).

In the emulsion the working electrolyte solution and the petroleum feedstock are in intimate contact. The oxidation by the metal ions, of the organo-sulfur compounds (which occurs along the interphase boundary between the feedstock and the electrolyte) changes the organo-sulfur compounds into water soluble compounds, gaseous products and water (i.e. $SO_2$, $CO_2$, $H_2O$).

The resulting water soluble compounds flow into the electrolyte where the oxidation of said compounds by metal ions proceeds further until the formation of gaseous products and sulfuric acid.

Concurrently with the oxidation of the organo-sulfur compounds at the interphase boundaries, reactions can proceed between the sulfuric acid and non-saturated (e.g., aromatic) hydrocarbons. This results in the formation of sulfonic acids, which are surface-active substances. These sulfonic acids and the oxygen-containing products, which result from the incomplete oxidation of hydrocarbons, can form resinous products which are insoluble in the electrolyte and in the petroleum product. These products then collect at the petroleum product/electrolyte interphase boundary.

The main factor which defines the predominate type of oxidation reaction is the sulfuric acid concentration in the electrolyte. Thus, if the concentration of sulfuric acid is high (i.e.>15M), then mainly sulfurization reactions take place and resins are formed. If the sulfuric acid concentration is less than 4M, then essentially no oxidation reactions occur. Thus, the working range of sulfuric acid concentration is 4–15M. A preferable concentration is 7–10M; in this regime the oxidation of organo-sulfur compounds proceeds reasonably fast and resins or other sulfonic acids are essentially not produced. However, any concentration of sulfuric acid within the range of 4–15M can be used as would be appropriate for the particular petroleum feedstock or required degree of purification.

The concentration of ion-oxidants has a slight affect on the type of oxidation reaction that will predominate (i.e. the selectivity of the oxidation process). Thus, this parameter may be varied within a wide range of possible values (i.e. from zero to that concentration which occurs in a saturated solution). The lower the concentration of ion-oxidants in the working solution the more solution is needed to pass through the electrolyzer (11) and through the emulsifier unit (12) to purify the same volume of petroleum product. The particular value of the ratio of the petroleum product and working solution flow rates is determined by the fact that 10–40 electrons are needed to oxidize an organo- sulfur molecule containing 1 atom of sulfur; these electrons are transferred from that molecule to the ion-oxidants. Depending of the nature (i.e., the composition) of the petroleum feedstock, this value can vary from 1–200 electrons per one atom of sulfur removed with the range of 10–40 electrons per one atom of sulfur removed being the most representative.

The petroleum/electrolyte emulsion runs from the emulsifier unit (13) to the de-emulsifier unit (15), where the spent working solution is separated from the petroleum product and resins. The spent working solution then goes into the electrolyzer with the water soluble oxidation products which are further oxidized in the electrolyzer and converted into sulfuric acid and gaseous products. Thus in the electrolyzer the successive sulfuric acid can be formed. In this case some part of the solution should be withdrawn into the neutralizer (28) where it is mixed with alkali fed from the source (31). Neutralization reaction products formed in the reactor (28), e.g. gypsum ($CaSO_4$), are then separated from the residual working solution by a vacuum filter (29) and stored in storage tank (30).

The petroleum product containing resins and sulfonic acids runs from the de-emulsifier unit (15) to the mechanical filter (16) which can be a vessel filled with an inert material such as silicon oxide or fiberglass. The resins and sulfonic acids separated-by the filter (16) and the same separated from the petroleum products in the de-emulsifier unit (15) flow into the centrifuge (20) where they are separated from the residual working solution, and are then stored in a storage tank (21). These resins and sulfonic acids can then be used as a feedstock for other processes including various petrochemical processes.

Another option involves running the petroleum product containing resins and sulfonic acids from the de-emulsifier unit (15) first to the centrifuge (20), where the main parts of the resinous and acidic components are separated, and then to a mechanical filter (16).

Normally at this stage of the purification process the sulfur content can be reduced from an initial level of 1000 ppm to 300–500 ppm, depending on the feedstock composition. However, the preferred embodiment, which provides a higher level of desulfurization of the petroleum product, employees additional purification as follows.

The petroleum product purified from the resins flows from the inert filter (16) into the alkaline filter (17) which is fed with an alkaline powder such as NaOH, $Ca(OH)_2$, or $Mg(OH)_2$ from the source (31).

The residual sulfuric acid, dissolved in the petroleum product is neutralized in the alkaline filter and precipitates in the form of solid products. Spent alkaline powder should then be removed from the filter (17) and stored in the storage tank (30).

Normally the petroleum product from the alkaline filter (17) is pure enough to be used in most applications. If the hydrocarbon feedstock contains less than 1000 ppm of sulfur, then after the alkaline filter (17) the petroleum will contain from 50 to 300 ppm of sulfur, depending on the nature of the original feedstock. At the same time that sulfur is removed from the feedstock the present process also removes other heteroatomic compounds such as nitrogen and heavy metals. The effectiveness of this process also depends on the nature of the original feedstock. In fact, some heteroatomic compounds, e.g., those containing nitrogen, are removed from the petroleum feedstock even more efficiently than the organo-sulfur compounds.

In those cases in which the amount of organo-sulphur compounds in the petroleum product after the alkaline filter (17) is still too high, the petroleum product can be further purified to reduce the sulfur concentration to less than 50 ppm. Also, in some cases (e.g. in diesel fuel) it is desirable to reduce the content of aromatic or polyaromatic compounds in the petroleum product. To address this situation, it is possible to route the petroleum product from the alkaline filter (17) into the adsorber (18) which is filled with a material, such as alumina, that selectively absorbs aromatic compounds and thiophenes. If the sulfur content in the petroleum product before adsorber (18) is in the range of 50–300 ppm, then after the adsorber it is reduced to 5–50 ppm. If required, the sulfur content can be further reduced to 0.5–5 ppm. However, for most cases this is not advisable since the rate of consumption of the alumina sorbent (viz., more than 1 liter of alumina powder per 1 liter of petroleum product) is high.

Purified petroleum product flows from the adsorber (18) into the product storage tank (19). The spent sorbent is removed from the adsorber (18) to the regeneration unit (22) where it is treated with hot air supplied from source (23). Regeneration of the spent sorbent is best performed at varying temperatures, i.e. air (or steam) having temperature of 200°–400° C. should be used first and then the air temperature should be increased to 500° C. or higher. At the lower temperature, the organic and heteroatomic compounds are removed from the alumina without being decomposed and therefore these compounds can be separated from the air (or steam) in the condenser (24), which is cooled by cold water supplied from a source (25). These separated compounds may be either used as a feedstock for the petrochemical industry or mixed with petroleum product feedstock to repeat the purification cycle. When the lower temperature sorbent regeneration is completed, heavier products (e.g. coke) can be removed by burning with an air stream having temperature of 500° C. or higher. Purified sorbent is then returned to adsorber (18) and the cooled air is exhausted into the ambient atmosphere.

In those cases where there is no need to reduce the concentration of aromatic compounds in the petroleum product after the alkaline filter (17), but the sulfur content should be further reduced, then additional purification can be accomplished by using a distillation technique in the presence of an alkaline material. In this case, the petroleum product flows to the still (35), which is loaded with dry alkali provided from stock (31). The petroleum product is heated, along with the alkali, by heater (37) and evaporated. The petroleum product vapors are then cooled using cold water provided from source (25) and condensed in condenser (36). The liquid petroleum product then runs into the storage tank (19*a*).

Heating the petroleum product in the presence of the alkaline material increases the reaction rate between the residual sulfuric acid dissolved in the petroleum product and the alkaline material and so the removal of acidic compounds from the petroleum product in the still (35) is even more efficient than in the alkaline filter (17). After evaporation of the petroleum product, the sulfuric acid salts remain in the still (35) and are thermally decomposed into products which normally do not contain sulfur since the sulfur is strongly bound to the alkali.

As a result of this additional purification, the total sulfur content in the petroleum product can be reduced from 300 ppm (after alkaline filter (17)) to 30–50 ppm (after condenser (36)).

Thus, the system shown in FIG. 2 reduces the amount of organo-sulfur compounds in petroleum feedstocks to varying levels depending on the details of the process, i.e. it reduces the sulfur content from an initial level of about 1000 ppm to 50–300 ppm after alkaline filter (17), or 30–50 ppm after the still (35), or 5–50 ppm after the adsorber (18). In addition, it removes heteroatomic compounds, including nitrogen and heavy metals, and, if required, can also reduce the amount of aromatic compounds in the petroleum product.

By-products of the purification system are as follows:

Minor amounts of combustion products which normally need no additional purification are released into the air;

Salts of sulfuric acid (e.g. gypsum) with an admixture (not more than 0.1%) of metals (i.e. V, Cr, Co, Ce, Mn) are accumulated in storage tank (30);

Resinous products containing sulfonic acids and oxygen-containing compounds are accumulated in storage tank (21);

Concentrated organo-sulfur and aromatic compounds at the outlet of the condenser (24);

Hydrogen gas (essentially with no pollutants) are accumulated in vessel (27).

Some of these by-products can be possibly used as feedstocks for the petrochemical industry.

Consumed resources include electric power, heat power, clean water (to prepare working solutions), lime, metals (i.e. V, Cr, Co, Ce, Mn) and cooling water. Sulfuric acid is essentially not consumed in the process.

Purification of 1 $m^3$ of diesel fuel with an initial sulfur content of less than 1000 ppm can be characterized by the following typical rates for consumed resources and final products yields:

| | |
|---|---|
| Input: | |
| Diesel fuel | 1000l |
| Electric power | 20 kW*hour |
| Clean water | 5l |
| Metals (e.g. V, Cr, Co, Ce, Mn) | 0.03 kg |
| Lime (CaO) | 5 kg |
| Air | 300 $m^3$ |
| Heat power | 0.03–0.05 GCal |
| Cooling water | 2 $m^3$ |
| Alumina | 0.05–0.10 kg |
| Output: | |
| Purified diesel fuel | 950–990l |
| Resins and sulfonic acids | 10–70 kg |
| Hydrogen | 2 $m^3$ |

-continued

| | |
|---|---|
| Gypsum | 5 kg |
| Concentrated organo-sulfur compounds and-aromatic compounds | 10–301 |
| Air containing less than 30 ppm sulfur oxides | 300 $m^3$ |
| Water (after drying of gypsum) | 51 |

These rates of resource consumption and final product yields can be used to estimate the cost of the purification process. The parameters for the removal of thiophenes from others petroleum products, e.g., rough benzene, would differ from those specified above.

Having described preferred embodiments of the present invention, various modifications thereof falling within the scope of the invention may become apparent to those skilled in this art, and the scope of the invention is to be determined by the appended claims and their equivalents.

What is claimed is:

1. A process for purifying a liquid hydrocarbon feedstock containing organo-sulfur compounds, which process comprises:

(a) forming an aqueous sulfuric acid solution containing an ion-oxidant containing a concentration of ions of a transition metal in a first, lower oxidation state;

(b) passing an electric current through the aqueous solution between an anode and a cathode in an electrolytic cell to oxidize said ions of said ion-oxidant to a second oxidation state higher than said first oxidation state so as to form a fresh working solution containing the resulting oxidized ions;

(c) introducing said feedstock and said working solution into a contacting zone and intimately contacting said feedstock and said working solution therein under conditions effective to oxidize organo-sulfur compounds in said feedstock and form water-soluble, or gaseous sulfur-containing compounds and to reduce said oxidized ions, so as to form a mixture of (i) a spent working solution containing the resulting reduced ions and having said water-soluble compounds dissolved therein and (ii) a purified hydrocarbon product containing a reduced level of said organo-sulfur compounds relative to the level thereof in said feedstock;

(d) separating said purified hydrocarbon product and said spent working solution;

(e) recovering the separated purified hydrocarbon product; and (f) returning the separated working solution to step (b) above to oxidize said reduced ions to a higher oxidation state.

2. The process of claim 1, wherein the transition metal is selected from the group consisting of manganese, vanadium, chromium, cobalt, cerium and mixtures thereof.

3. The process of claim 2, wherein the transition metal is vanadium, chromium or manganese.

4. The process of claim 1, wherein the working solution in step (b) has a concentration of sulfuric acid in the range of 4–15M.

5. The process of claim 1, wherein the contacting of step (c) above is effected in an emulsion of said feedstock and said working solution.

6. The process of claim 1, further including passing the recovered purified hydrocarbon product through a filter to remove therefrom acidic components and resinous by-products resulting from the oxidation of the organo-sulfur compounds.

7. The process of claim 6, wherein the filter comprises at least a filter comprising an alkaline material.

8. The process of claim 6, wherein the filter comprises at least a filter comprising an inert material.

9. The process of claim 6, wherein the resulting filtered hydrocarbon product is subjected to distillation in the presence of an alkaline material.

10. The process of claim 6, wherein the resulting filtered hydrocarbon product is further passed through a particulate adsorbent material effective to adsorb said acidic components and by-products which remain in the filtered hydrocarbon product.

11. The process of claim 10, wherein the adsorbent material comprises alumina.

12. The process of claim 10, further including subjecting the resulting spent adsorbent material containing absorbed acidic components and resinous by-products to contact with an oxygen-containing gas at an elevated temperature to remove said acidic components and by-products there from.

13. The process of claim 1, wherein the separation of step (d) comprises passing the emulsion to a de-emulsifier to separate the purified hydrocarbon product and spent working solution, passing the resulting separated spent working solution to the electrolytic cell, and centrifuging the resulting separated purified hydrocarbon product to remove therefrom acidic components and resinous by-products resulting from the oxidation of the organo-sulfur compounds.

14. The process of claim 1, wherein, prior to being introduced into the contacting zone, the feedstock has been subjected to a preliminary purification to reduce the level of unsaturated or oxygen-containing organic compounds contained therein.

15. The process of claim 14, wherein the preliminary purification comprises hydro-refining the feedstock.

16. The process of claim 1, wherein said feedstock is substantially free of unsaturated and oxygen-containing organic compounds and contains less than about 1000 ppm sulfur.

17. The process of claim 1, wherein the working solution in step (b) has a concentration of sulfuric acid in the range of 6–12M.

18. The process of claim 1, wherein the working solution in step (b) has a concentration of sulfuric acid in the range of 7–10M.

19. The process of claim 1, wherein the concentration of said metal ions in the fresh working solution is at least 1% of the concentration of these ions in a saturated metal ion solution.

20. The process of claim 1, wherein said conditions include: a pressure of about 1 atmosphere; a temperature of about 25° C.; an aqueous solution containing about 50–90 wt % sulfuric acid and about 0.5 wt % ion-oxidant; and an emulsion of the feedstock and working solution in which the said feedstock and working solution are in intimate contact.

21. The process of claim 1, wherein the amount of the electric current passed through the aqueous solution is from about $10^6$ to about $4\times10^6$ coulombs per one mole of sulfur contained in the feedstock introduced into said contacting zone.

* * * * *